US006206782B1

(12) United States Patent
Walker et al.

(10) Patent No.: US 6,206,782 B1
(45) **Date of Patent: *Mar. 27, 2001**

(54) SYSTEM AND METHOD FOR FACILITATING CASINO TEAM PLAY

(75) Inventors: Jay S. Walker, Ridgefield; James A. Jorasch, Stamford; Magdalena Mik, Greenwich; Jason Krantz, Wilton, all of CT (US)

(73) Assignee: Walker Digital, LLC., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/152,402

(22) Filed: Sep. 14, 1998

(51) Int. Cl.[7] ..... A63F 9/24

(52) U.S. Cl. ..... 463/25; 463/20; 463/26; 463/27

(58) Field of Search ..... 463/20, 25, 26, 463/27, 28; 700/91

(56) References Cited

U.S. PATENT DOCUMENTS 4,636,951 1/1987 Harlick .
5,159,549 10/1992 Hallman, Jr. et al. .
5,344,144 9/1994 Canon .
5,511,781 * 4/1996 Wood et al. ..... 273/85 CP
5,564,700 * 10/1996 Celona ..... 463/27
5,580,309 12/1996 Piechowiak et al. .
5,593,349 * 1/1997 Miguel et al. ..... 463/30
5,766,076 6/1998 Pease et al. .

OTHER PUBLICATIONS

"Mega Vigil", Las Vegas Advisor, Jul. 1998 at p. 12.

* cited by examiner

*Primary Examiner*—Michael O'Neill
*Assistant Examiner*—Julie Kasick
(74) *Attorney, Agent, or Firm*—Steven M. Santisi

(57) ABSTRACT

A method is disclosed for facilitating group play by a team of members associated with a casino slot club. The method includes the steps of identifying the team members, identifying a set of rules designated by the team for rewarding the team members when a payout is due to one of the team members, detecting a payout due to one of the team members, and rewarding the team members in accordance with the set of rules.

53 Claims, 11 Drawing Sheets

140

| PLAYER IDENTIFIER 141 | TEAM IDENTIFIER 142 | DATE OF LAST ACTIVITY 143 | TOTAL DOLLAR VOLUME OF PLAY TO DATE 144 | TOTAL EARNED FROM TEAM MEMBERSHIP TO DATE 145 | TEAM BONUS OWED TO PLAYER 146 | SLOT CLUB REWARD POINTS 147 | NAME 148 |
|---|---|---|---|---|---|---|---|
| 123456 | R100 | 7/02/98 | $60,285 | $575 | $525 | 4,019 | JOHN DOE |
| 234567 | S110 | 03/16/98 | $98 | $20 | $20 | 7 | BOB SMITH |
| 345678 | T101 | 02/13/98 | $1,721 | $50 | $50 | 115 | REBECCA ANDERSON |
| 456789 | R100 | 06/29/98 | $68,910 | $575 | $16 | 4,594 | JANE DOE |
| 567890 | T101 | 06/22/98 | $6,450 | $50 | $50 | 335 | JENIFER ROGERS |
| 678901 | T101 | 06/14/98 | $1,929 | $50 | $50 | 129 | EILEEN SHIN |
| 789012 | S110 | 03/15/98 | $445 | $40 | $3 | 30 | ANDREW FROTH |
| 890123 | N/A | 07/01/98 | $2,241 | N/A | N/A | 149 | ALEX SCHWARTZ |

150

| TEAM IDENTIFIER: R100 151 | | |
|---|---|---|
| TEAM PLAN IDENTIFIER: ABC 152 | | |
| PLAYER IDENTIFIER 153 | ELIGIBILITY STATUS 154 | ACTIVITY STATUS 155 |
| 123456 | ELIGIBLE | NOT ACTIVE |
| 567890 | ELIGIBLE | ACTIVE |
| 678901 | ELIGIBLE | ACTIVE |
| 901234 | NOT ELIGIBLE | NOT ACTIVE |

140

| PLAYER IDENTIFIER 141 | TEAM IDENTIFIER 142 | DATE OF LAST ACTIVITY 143 | TOTAL DOLLAR VOLUME OF PLAY TO DATE 144 | TOTAL EARNED FROM TEAM MEMBERSHIP TO DATE 145 | TEAM BONUS OWED TO PLAYER 146 | SLOT CLUB REWARD POINTS 147 | NAME 148 |
|---|---|---|---|---|---|---|---|
| 123456 | R100 | 7/02/98 | $60,285 | $575 | $525 | 4,019 | JOHN DOE |
| 234567 | S110 | 03/16/98 | $98 | $20 | $20 | 7 | BOB SMITH |
| 345678 | T101 | 02/13/98 | $1,721 | $50 | $50 | 115 | REBECCA ANDERSON |
| 456789 | R100 | 06/29/98 | $68,910 | $575 | $16 | 4,594 | JANE DOE |
| 567890 | T101 | 06/22/98 | $6,450 | $50 | $50 | 335 | JENIFER ROGERS |
| 678901 | T101 | 06/14/98 | $1,929 | $50 | $50 | 129 | EILEEN SHIN |
| 789012 | S110 | 03/15/98 | $445 | $40 | $3 | 30 | ANDREW FROTH |
| 890123 | N/A | 07/01/98 | $2,241 | N/A | N/A | 149 | ALEX SCHWARTZ |

FIG. 4

150

| TEAM IDENTIFIER: R100 151 | | |
|---|---|---|
| TEAM PLAN IDENTIFIER: ABC 152 | | |
| PLAYER IDENTIFIER 153 | ELIGIBILITY STATUS 154 | ACTIVITY STATUS 155 |
| 123456 | ELIGIBLE | NOT ACTIVE |
| 567890 | ELIGIBLE | ACTIVE |
| 678901 | ELIGIBLE | ACTIVE |
| 901234 | NOT ELIGIBLE | NOT ACTIVE |

FIG. 5

160

| TEAM PLAN IDENTIFIER 161 | PAYOUT THRESHOLD 162 | BONUS AMOUNT 163 | ACTIVITY MULTIPLIER 164 | ELIGIBILITY REQUIREMENTS 165 |
|---|---|---|---|---|
| ABC | $500 | 10% | 2 | OUTSTANDING HOTEL RESERVATION |
| BCD | $1 | 0.5% | 1.5 | AT LEAST ONE PLAY SESSION PER 30 DAYS |
| DEF | $1,000 | $100 | 1 | $500 PER CALENDAR QUARTER |
| FGH | $800 | $800 | 3 | AT LEAST ONE PLAY SESSION PER YEAR |

FIG. 6

SYSTEM AND METHOD FOR FACILITATING CASINO TEAM PLAY

BACKGROUND OF THE INVENTION

1. Field of the Invention

The present invention relates generally to casino gaming devices, and more particularly, to a system and method for facilitating and rewarding team play of such gaming devices.

2. Description of the Related Art

The recent proliferation of casino gambling institutions in non-traditional locations such as Native-American reservations, riverboats, and cruise ships has placed significant competitive pressure on casinos in more traditional locations such as Las Vegas and Atlantic City to attract and retain customers. Moreover, in most traditional gambling locales, there exist a substantial number of casinos which compete head-to-head for the same group of gamblers. For example, the Las Vegas strip alone has over thirty casinos in direct competition with one another. Thus, the competition to draw players into a particular casino and have them return again has become an extremely difficult task for casino owners.

Increasingly, casinos are offering incentives in an effort to attract customers and retain them over time. For example, progressive slot machines featuring relatively large progressive jackpots have been employed to entice players into casinos. However, these machines pay out infrequently and are becoming commonplace. Consequently, they are becoming less attractive to many players. Moreover, since progressive jackpots are found in most casinos, they do not encourage players to choose one casino over another.

Casinos have also formed player slot clubs as a method of attracting and retaining customers. Such slot clubs operate to enroll players and allow them to earn reward points for gambling activity. Reward points may be exchanged for lodging, food or other services offered at a casino. Often, however, a player may join several slot clubs and become associated with a number of casinos. Consequently, for some players, the incentive to visit a particular casino no longer exists, rendering the present casino slot club format ineffective for its intended purpose.

In looking for new ways to attract and retain customers, casinos have sought to improve the experience of slot machine play by implementing systems for creating a group play format, so as to attract greater numbers of customers into a casino. For example, U.S. Pat. No. 5,564,700 to Celona describes a system for splitting a progressive jackpot amongst multiple players of linked gaming machines when a player at one machine hits the progressive winning combination. By splitting the jackpot amongst the players, the system creates the semblance of group play, thereby enhancing the gambling experience for some players. However, aside from the fact that the players are linked by a group of machines, the group aspect of the game is quite passive, and does not increase a player's loyalty to a particular casino.

U.S. Pat. No. 5,766,076 to Pease et al. describes a progressive gaming system in which multiple casinos or other groupings are coupled to a central system, and the central system provides each casino or group with a predetermined number of chances at a prize for each buy-in, i.e., each multiple of a predetermined amount of contribution to the prize or jackpot. If a prize is awarded as a result of such a buy-in, the casino or group randomly splits the prize amongst the players who are actively playing in that casino or group. Thus, it is possible for a player to win a progressive jackpot even though that player is not present in the casino in which the winning gaming device is located. However, since the Pease et al. system is configured to select a winner at random, the players are unable to influence the outcome of a game or the distribution of the award amongst the members of the group.

Pease et al. also discloses a system for tracking the activity of a group of players to facilitate the random distribution of a prize. Player tracking, as the name indicates, involves tracking individual player usage of gaming devices. In prior art player tracking systems, the player is issued a player identification card which has encoded thereon a player identification number that uniquely identifies the player. The individual gaming devices are fitted with a card reader, into which the player inserts a player-tracking card prior to playing the associated game.

By tracking individual players, usage can be monitored, allowing gaming establishments to target individual players with direct marketing techniques such as bonuses or rewards. U.S. Pat. No. 5,752,882 to Acres et al. describes a prior art player tracking system which facilitates communication between a network of gaming devices to provide a variety of promotional bonuses such as multiple jackpot bonuses, mystery jackpot bonuses, progressive jackpot bonuses, or player specific bonuses.

Consequently, despite recent attempts in the prior art to attract groups of players to casinos by creating a group playing environment, the systems presently in place do not enable the members of a group to influence or direct the distribution of a winning jackpot amongst the group members. Thus, the allure of such systems is relatively small.

SUMMARY OF THE INVENTION

The present invention is directed to a new and useful system and method for enhancing the experience of slot machine play by facilitating group play by members of a team associated with a casino slot club and by enabling the team to directly influence the distribution of a winning jackpot amongst its members. It would be desirable to both payers and casinos to provide a system for facilitating group play which enables the group members to influence or direct the distribution of a winning jackpot amongst the group. Such a system would serve to bring greater numbers of players into a casino and retain their loyalty to the casino over time, thereby increasing the casino's profits.

In accordance with an exemplary embodiment of the present invention, the system for facilitating group play by a team of members associated with a casino slot club comprises a memory storage device and a processor. The memory storage device contains a player database including information relating to each team member, a teams database including information relating to each team, and a team plan database including information relating to a set of rules for allocating rewards to the members of the team when a payout is obtained by, or is due to, a particular team member.

The processor is adapted and configured to receive a player identifier corresponding to a team member and receive a signal indicating a payout to the team member. The processor is further adapted to retrieve information relating to the player from the player database, retrieve information from the teams database relating to the player's team and retrieve information from the team plan database relating to the rules for rewarding the members of the player's team. In addition, the processor is configured to evaluate the set of rules, and distribute a reward to each team member in accordance with the set of rules.

Generally, in accordance with an exemplary embodiment of the present invention, a method is provided for facilitating group play by a team of members which comprises the steps of identifying the members of the team, identifying a set rules for rewarding the members of the team when a payout is due to a game-playing team member, detecting a payout due to a game-playing team member, and rewarding the members of the team in accordance with the set of rules.

The step of identifying a set of rules for rewarding members of the team includes identifying a set of rules in a team plan database designated by the team. The rules or team plan can include, among other things, a minimum payout threshold, one or more player eligibility requirements, a bonus activity multiplier, and a condition for effecting reward multiplication, such as player activity.

These and other features of the system and method disclosed herein will become more readily apparent from the following description of the drawings.

BRIEF DESCRIPTION OF THE DRAWINGS

So that those having ordinary skill in the art to which the disclosed system and method pertains will more readily understand how to employ and use the same, reference may be made to the drawings wherein:

FIG. 4 is a sample illustration of a player database arranged in accordance with an embodiment the present invention;

FIG. 5 is a sample illustration of a team record of a teams database arranged in accordance with an embodiment of the present invention;

FIG. 6 is a sample table of a team plan database arranged in accordance with an embodiment of the present invention;

These and other features of the system and method disclosed herein will become more readily apparent to those having ordinary skill in the art from the following detailed description of the preferred embodiments taken in conjunction with the drawings.

DETAILED DESCRIPTION OF THE INVENTION

The present invention provides a system and method for facilitating group play by members of a team associated with a casino slot club or similar association. In so doing, the system and method can help to attract and retain players, thereby increasing the profitability of the casino.

Throughout the specification that follows, the terms "player" and "member" shall be used interchangeably to describe a person associated with a particular"team" or "group". In addition, the terms "gaming machine" or "gaming device" shall be used interchangeably and shall refer to any electronic game of the type wherein a wager results in an outcome to determine a payout. Such electronic games include slot machines, video poker machines, video blackjack machines, lottery machines, bingo machines and keno machines. By way of example, an embodiment of the present invention shall be described herein with respect to a slot machine. Also throughout the specification, the phrase "game-playing team member" shall refer to and include a team member who is actively playing an electronic gaming machine or device at a casino. It should also be recognized that the terms "reward", "award" and "bonus" shall be used interchangeably throughout the specification and shall refer to a monetary or non-monetary prize distributed amongst members of a team or group.

Figure 1:
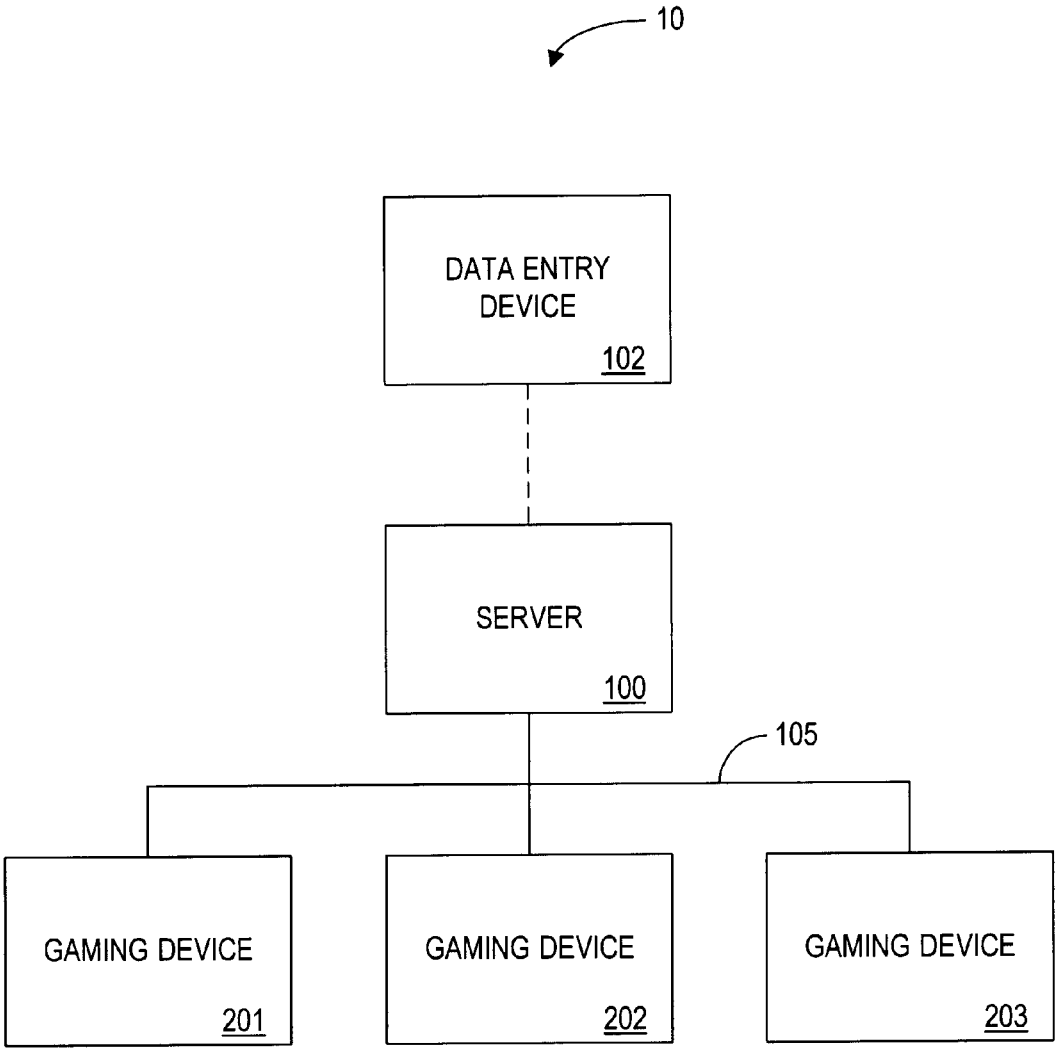
FIG. 1 is a schematic representation of a system configured in accordance with the present invention.

Referring now to the drawings wherein like reference numerals identify similar elements of the present invention, there is illustrated in FIG. 1 a system 10 constructed in accordance with an embodiment of the present invention which includes a slot server 100, a data entry device 102 and a plurality of gaming devices 201, 202 and 203. Server 100 comprises a commercially available computer server, such as, an IBM RS 6000 or the like. Data entry device may comprise a kiosk via which players register for a team. A data communications system 105, which may take the form of a local or wide area network, links the gaming devices to the server. Those skilled in the art will readily appreciate that the precise type of network is not of import and that the network may be wired or wireless.

Figure 2:
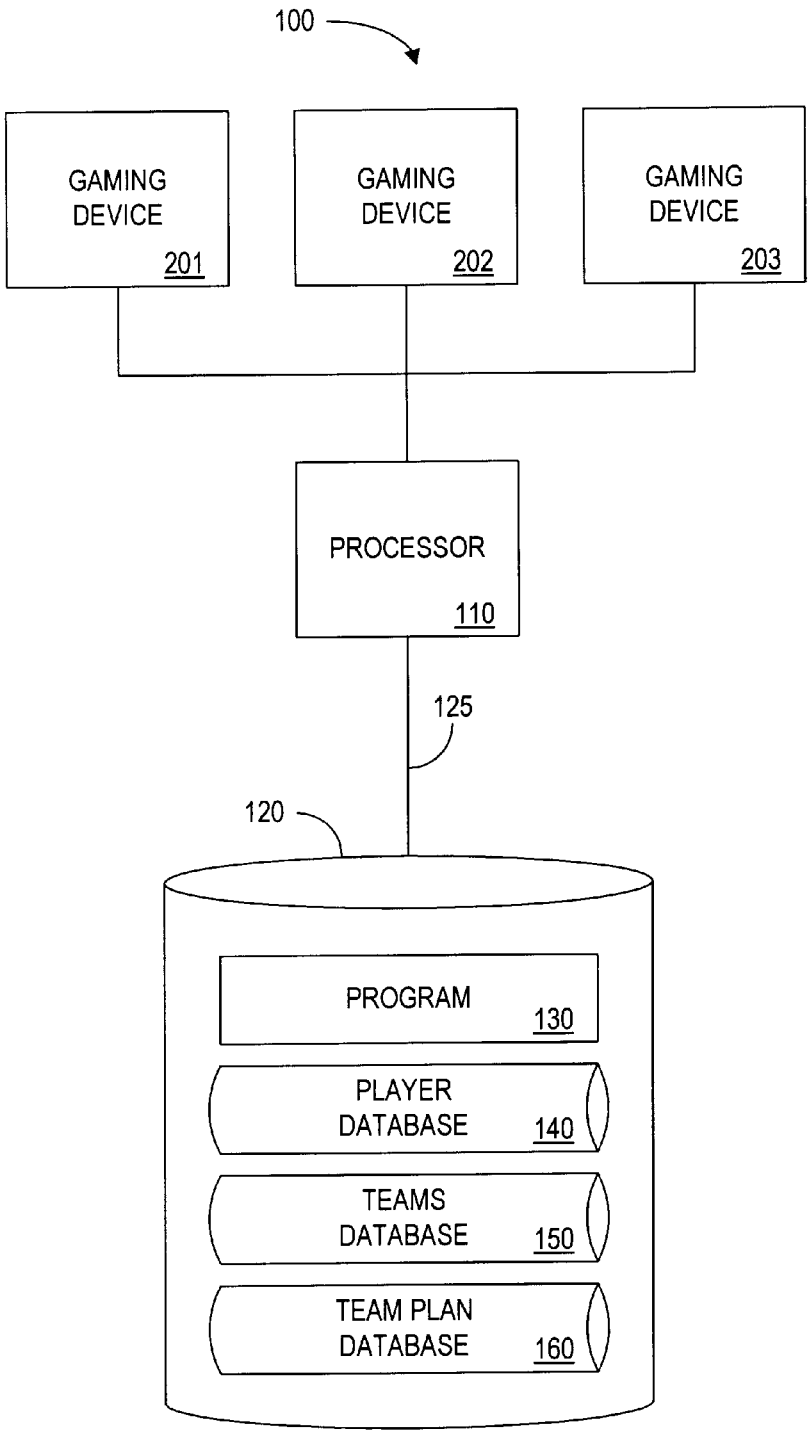
FIG. 2 is a schematic representation of a server configured in accordance with an embodiment of the present invention.

Referring to FIG. 2, server 100 includes a processor 110 and a memory storage device 120 connected by an appropriate data communications channel 125. Memory storage device 120 comprises at least one of a selected semiconductor, magnetic and/or optical memory component, as is well known in the art. Memory storage device 120 contains a program 130 having instructions for allowing processor 110 to control the operation of server 100 in accordance with the present invention. In addition, memory storage device 120 contains a plurality of databases, including a player database 140 for receiving and retaining data relating to each player in the casino slot club, a teams database 150 for receiving and retaining data relating to each team and to the members associated therewith, and a team plan database 160 for receiving and retaining data relating to the rules or conditions for allocating or distributing rewards or bonuses to team members. Each database will be described in detail below.

Figure 3:
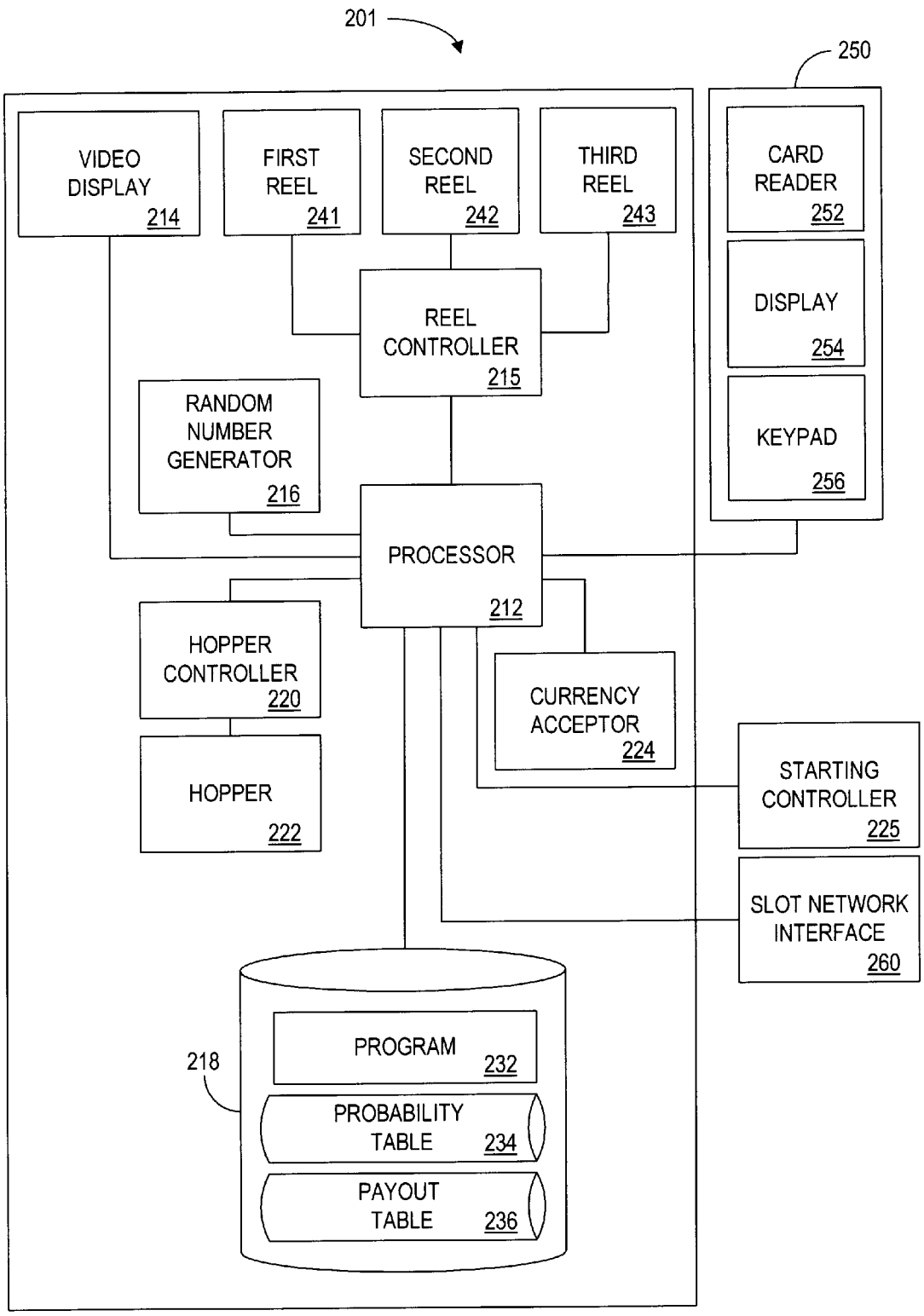
FIG. 3 is a schematic representation of a slot machine configured in accordance with an embodiment of the present invention.

Referring to FIG. 3, there is illustrated an exemplary electronic gaming device in the form of a slot machine 201. As stated previously, in an embodiment of the present invention, gaming devices 201, 202, and 203 comprise slot machines. Slot machine 201 includes central processing unit (CPU ) 212, which may comprise a commercially available microprocessor such as an Intel Pentium™ microprocessor or the like. A video display 214 in the form of a cathode ray tube (CRT), liquid crystal display (LCD) or light emitting diode (LED) is connected to CPU 212, along with a reel controller 215, a random number generator 216 and data storage device 218. In addition, a hopper controller 220 and associated hopper 222 are connected to CPU 212.

The reel controller 215 operates a first reel 241, second reel 242 and third reel 243 of gaming device 201. As in conventional slot machines, each reel contains a set of objects and/or symbols for depicting a particular outcome. Alternatively, the gaming device may include a video display area which provides a graphical representation of the objects and/or symbols included on a conventional reel. The symbols may include, for example, lemons, cherries, bells, etc.

The random number generator 216 is adapted and configured to generate a random or a pseudo-random number to determine an outcome and payout. Alternatively, the random number generator can be implemented in software and thus random numbers would be generated by CPU 212. Hopper controller 220 is adapted and configured to control the dispensing of moneys form hopper 222, typically in the form of coins or tokens. A currency acceptor, typically in the form of a coin acceptor 224 is operatively connected to CPU 212 for signaling the CPU upon receipt of currency from the player. The structure and operation of random number generator 216, hopper controller 220, hopper 222 and coin acceptor 224 are well known in the art.

Data storage device 218 comprises at least one of a selected semiconductor, magnetic and/or optical memory components well known in the art. The data storage device 218 contains a program 232 providing instructions for the operation of CPU 212, a conventional probability table 234 for providing the probability of a particular outcome based upon the number provided by the random number generator, and a conventional payout table 236 for providing the appropriate payout amount corresponding to each particular outcome.

A starting controller 225 is also provided for sending a signal to CPU 212indicating a player request to initiate play, as is well known in the art. The starting controller 225 may comprise a handle which could be manipulated by a player or a button that can be actuated by a player. In addition, a player tracking device 250 is operatively associated with gaming device 201. Tracking device 250 includes a card reader 252 for reading a data storage card (not shown) having player identification information encoded thereon. Data storage cards of this type may include electronic, magnetic and/or optical storage media. The player-tracking device 250 further includes a display 254 for providing information to the player and an associated data entry device 256 for enabling the player to interface with the system. Display 254 may be in the form of an LCD or LED device and can be used to display bonus information or other targeted messages to a player. Data entry device 256 may be in form of a numeric keypad or similar device. A slot network interface 260 is also associated with gaming device 201 and is operatively connected to CPU 212 in a known manner. Slot network interface 260 preferably comprises appropriate communication port or card for enabling communication between gaming device 201 and server 100. The types of information that may be communicated via slot network interface 260 may include player identifiers, game outcomes, and coin in, for example.

Referring now to FIG. 4, the player database 140 contained in storage device 120 of server 100 includes a plurality of fields for storing information associated with each player registered in a particular casino slot club. In accordance with an embodiment of the present invention, the player database 140 includes: (1) a field 141 for storing a numeric player identifier associated with each player registered in the casino slot club; (2) a field 142 for storing an alpha-numeric team identifier associated with each player or member of a particular team associated with the casino slot club; (3) a field 143 for storing information relating to the last date of player activity for each player in the casino slot club; (4) a field 144 for storing the total dollar volume of play to date for each player in the casino slot club; (5) a field 145 for storing the total dollar amount earned from team membership to date for each player in the casino slot club; (6) a field 146 for storing the team bonus owed to each player in the casino club; (7) a field 147 for storing the number of slot club award points held by each player in the casino club; and (8) a field 148 for storing the name of each registered player. Since each player registered with the slot club is not necessarily a member of a team, certain fields of a player's record may remain empty. For example, team identifier field 142 may contain an entry of "N/A" or "Not Applicable" if a player is not registered with a particular team. Other fields may have similar information contained therein.

Referring to FIG. 5, the teams database 150 contained in storage device 120 of server 100 includes a plurality of team records such as record 50, each having a plurality fields for receiving information associated with each player registered with a particular team in a casino slot club as well as identifying information relating specifically to the team. In accordance with an embodiment of the present invention, the fields in each team record include: (1) a field 151 containing the team identifier associated with the team; (2) a field 152 containing the team plan identifier associated with the team; (3) a field 153 for retaining the numeric player identifier for each team member associated with the team; (4) a field 154 for storing the eligibility status for each team member (i.e., "ELIGIBLE" or "NOT ELIGIBLE"); and (5) a field 155 storing the activity status of each team member (i.e., "ACTIVE" or "NOT ACTIVE"). The team identifier and team plan identifier are entered and stored during the registration process described hereinbelow and illustrated in the process flowchart of FIG. 7. Eligibility and status requirements are elements of the team plan designated by the members of the team upon registration to facilitate the distribution of rewards and bonuses amongst the team members. Activity status generally indicates whether a player is currently playing a gaming device in the casino sponsoring the slot club.

Player eligibility requirements may depend upon frequency of play. For example, to be eligible to receive a reward or bonus, a team member must have played the particular casino he is registered with within a given time period (e.g. within the pervious thirty days). Alternatively, the eligibility of a team member may depend upon the amount a wager. For example, to be eligible to receive a reward or bonus a team member must have wagered a minimum amount of money during a given time period (e.g. ten thousand dollars wagered within the previous thirty day period). Those skilled in the art will readily appreciate that any number of different requirements can be designated by a team upon registration. If a player fails to meet an eligibility requirement set forth in a team plan. then that player would not share in a team reward or bonus. Player eligibility may be reinstated when the given requirements are met. It is envisioned that eligibility requirements can be selected from a set of predetermined rules or they can be custom designed by the team members. In either instance, it would be possible to revise the team plan should the casino or team members decide to change the eligibility requirements for the team.

A player's activity status in the team database relates to the amount of the bonus that may be distributed to the player when a payout is obtained by or is due to another game-playing team member. More particularly, player activity can be linked to the activity multiplier contained in field 164

(discussed below with reference to FIG. 6) to determine or effect the player's reward or bonus. For example, if a team plan included an activity multiplier of two, a team member's bonus could be increased two-fold if they are an active player when a payout is received by a team member. It is envisioned that player activity at the casino would be tracked by a player tracking device operatively associated with gaming devices in the casino, such as, for example, player tracking device 250 associated with gaming machine 201. Thus, every time a player inserts their tracking card into a card reader, their activity status in field 155 of the team database is set to "ACTIVE". However, it is also envisioned that activity status need not be dependent upon activity at the casino. For example, a team member's activity status in field 155 can be altered by accessing a web-site containing a set of product advertisements or by placing a telephone call to hear a pre-recorded message providing promotional information. Those skilled in the art will readily appreciate that any number of different mechanisms may be designated by a casino or by the members of a particular team to effect alteration of a player's activity status.

Referring now to FIG. 6, the team plan database 160 contained in storage device 120 is adapted and configured to receive and store data related to the set of predetermined rules, parameters or conditions designated by each team to govern the distribution and/or allocation of bonuses amongst its members. In accordance with an embodiment of the present invention, team plan database 160 has a plurality of fields which include: (1) a field 161 for storing the team plan identifier associated with each team in the casino slot club; (2) a field 162 for storing the payout threshold designated by each team in the casino slot club; (3) a field 163 for storing the bonus amount designated by each team in the casino slot club; (4) a field 164 for storing the activity multiplier designated by each team in the casino slot club; and (5) a field 165 for storing the eligibility requirements designated by each team in the casino slot club.

The team plan identifier in field 161 designates specific plans which may be selected by the members of a team. As discussed herein, a team plan can be selected from a group of plans designed by the casino, or it can be customized by the team members themselves. The payout threshold in field 162 defines the payout amount that will trigger the distribution or allocation of a reward or bonus amongst the members of a team. For example, a team may chose to set the payout threshold at one thousand dollars. Thus, rewards or bonuses would be distributed in accordance with the team plan when one of the team members obtains a payout that exceeds one-thousand dollars. Alternatively, the team may decide that bonuses should be distributed when the payout is greater than or equal to the payout threshold.

The bonus amount stored in field 163 of team plan database 160 defines the amount of the bonus the team members will receive when a team member receives or is due a payout. The bonus amount can be a percentage of the jackpot of the winning team member (e.g., ten percent), or a fixed dollar amount (e.g., one hundred dollars). It is envisioned that team bonuses may be subtracted from a winning team members jackpot whereby the winning team member receives only the remainder of the payout, or team bonuses may be paid out by the casino such that the winning team member receives the entire jackpot. It is also envisioned that team bonuses can be non-monetary rewards such as lodging, food or other services offered at a casino.

The activity multiplier stored in field 164 of team plan database 160 defines the factor by which a bonus amount may be increased for a team member whose status is active at the time a payout is received by, or is due to, a winning team member. The activity multiplier, or multiplication factor may be a whole number or a fractional number. For example, as illustrated in FIG. 6, team plan "FGH" designates the activity multiplier as three. Thus, upon distribution of a bonus, an active team member would receive a bonus equal to three times the amount of the bonus amount set forth in field 163 of the team plan database 160.

There may arise an instance wherein a team will decide that the distribution of bonuses amongst its members should not be determined, at least in part, by the play activity of its members, i.e., the fact that a team member is active at the time a reward is distributed should not serve to increase the amount of their bonus. In such a case, the activity multiplier in field 163 would be set to one. Thus, the reward distribution would be based solely upon eligibility requirements set forth in field 165 of team plan database 160.

The eligibility requirements set forth in field 165 of team plan database 160 define the rules for distributing or allocating bonuses to team members when a team member receives or is due a payout. As stated previously, eligibility requirements are variable and may be designated to depend upon the frequency of play or the amount wagered by a particular player during a given time period. For example, as illustrated in FIG. 6, team plan "DEF" designates in field 165 that to be eligible for a bonus a player must have wagered five hundred dollars during the previous calendar quarter. Alternatively, team plan "ABC" provides that eligibility to receive a bonus is based upon whether a team member has an outstanding hotel reservation at the casino in which the team has registered.

Other requirements may include that a team member place a telephone call to the casino during a given time period to hear an advertisement concerning certain goods or services offered by the casino, or that the team member submit to the casino proof of purchase of certain goods or services offered by the casino or by others having a partnership arrangement with the casino, such as an airline or hotel chain.

Those skilled in the art will readily appreciate that a team may base bonus eligibility on one or more of a number of criteria or conditions associated with game play or with the casino. In accordance with the present invention, if a player fails to meet an eligibility requirement, they would not receive a reward or bonus when a team member receives or is due a payout which is equal to or in excess of the payout threshold designated in the team plan database. However, a player who is ineligible may alter their eligibility status and become eligible to receive a bonus once they have met the eligibility requirements set forth in the team plan.

By way of example, players 1 through 5 register a slot club team identified as "Z100" with a team plan "XYZ" that provides a payout threshold of one thousand dollars ($1000), a team bonus amount of ten percent (10%) for all eligible team members (i.e., those whose club membership has not lapsed), and an activity multiplier of two (2) which would yield a twenty percent (20%) net bonus to all active team members. The team plan further provides that team bonuses are to be paid out by the casino rather than subtracted from the jackpot of a winning team member.

Of the five team members, players 1, 2 and 3 join one another on a trip to the casino in which team "Z100" is registered. At such a time, player 4 is eligible to receive a team bonus, but player 5 whose club membership has lapsed, is not eligible for a bonus. During the course of their visit to the casino, player 1 hits a jackpot worth ten thousand dollars ($10,000). At the same time, player 2 is actively playing a gaming device, but player 3 is dinning at a nearby restaurant and is thus not active. In accordance with team plan "XYZ", player 1 collects the dollar amount the jackpot ($10,000), player 2 who is eligible and active receives a team bonus equal to twenty percent of the jackpot ($2,000), player 3 who is eligible and not active receives a team bonus equal to ten percent of the jackpot ($1,000), player 4 who is also eligible and not active receives a team bonus equal to ten percent of the jackpot ($1,000) and player 5 who is ineligible does not receive a team bonus.

Figure 7:
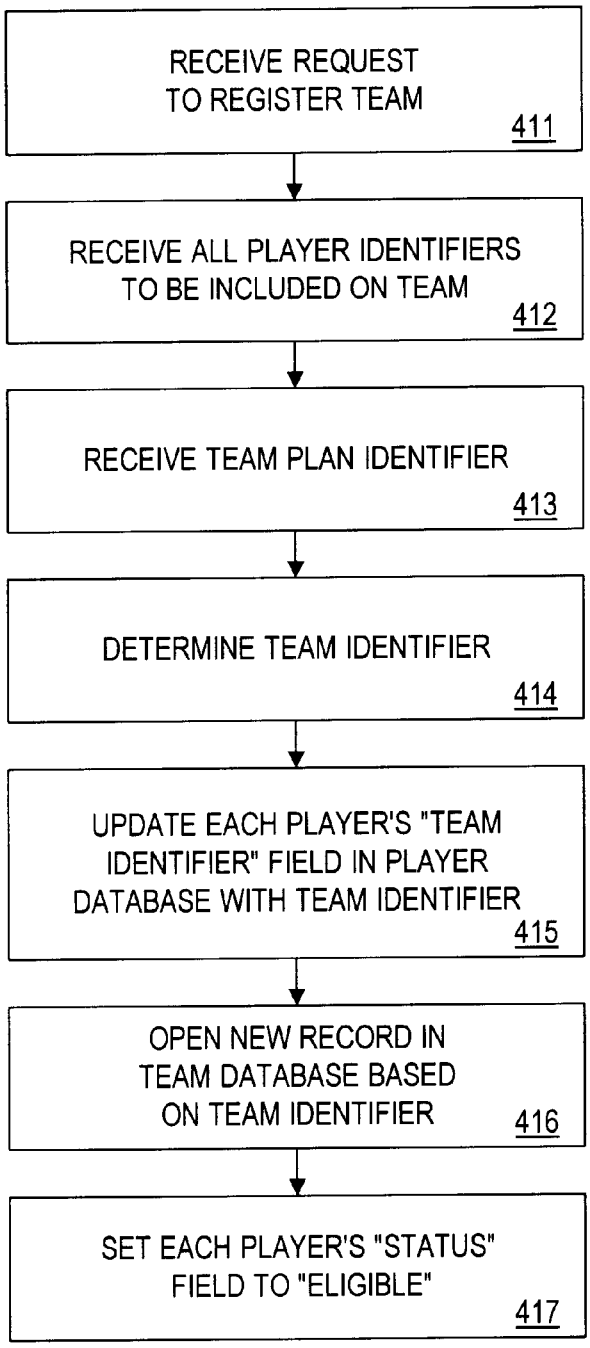
FIG. 7 is a flowchart depicting a process for facilitating the registration of a team of players in accordance with an embodiment of the present invention.

Referring to FIG. 7, the process for registering a team or group with the casino slot club includes the step 411 of receiving a request to register a team. Such a request may be entered through data entry device 102 and transmitted to server 100 for storage (see FIG. 1). It is envisioned that registration can occur at an on-site terminal located in a particular casino, or from a remote terminal which would communicate with the server through a data communication network such as a modem or the Internet. The process further includes the step 412 of receiving and storing all player identifiers to be included on a particular team in field 153 of teams database 150. Player identifiers preferably comprise numeric expressions although alternative identifiers may be employed. Step 413 in the team registration process includes receiving and storing a team plan identifier in field 152 of teams database 150, which is the data expression that identifies the particular rules or parameters associated with the distribution of bonuses amongst the members of the team when a team member obtains or is due a payout. A team plan may be selected from a number of pre-arranged plans, such as those illustrated in team plan database 160, or it may be customized in accordance with the preferences of the members of a particular team. In a preferred embodiment of the present invention, wherein the team plan is selected from a number of pre-arranged plans, step 413 would include the additional steps of presenting the various team plans contained in team plan database 160 to the team members for selection and subsequently receiving the team's selection.

With continuing reference to FIG. 7, the process for registering a team further includes the step 414 of determining the team identifier. More particularly, this step involves designating and storing an alpha-numeric expression in field 142 of player database 140 which corresponds to the newly registered team. It is envisioned that the team identifier may be determined by the system and assigned to the team, or it may be selected and input by the team. Step 415 in the registration process includes updating and storing each player's team identifier in field 142 of the player database 140 with the team identifier previously determined in step 414. The registration process further includes the step 416 of opening or generating a new team record 50 in the teams database 150 located in the storage device 120 of server 100. At step 417 the value in the eligibility status field 154 of the team record 50 is set to "ELIGIBLE" indicating that each player on the team is initially eligible to receive a reward or bonus in accordance with the team plan. The player identifier corresponding to each player registered with a newly formed team is stored in field 153 of the team record 50 and the team plan identifier chosen by the team is stored in field 152 of the team record 50.

Figure 8:
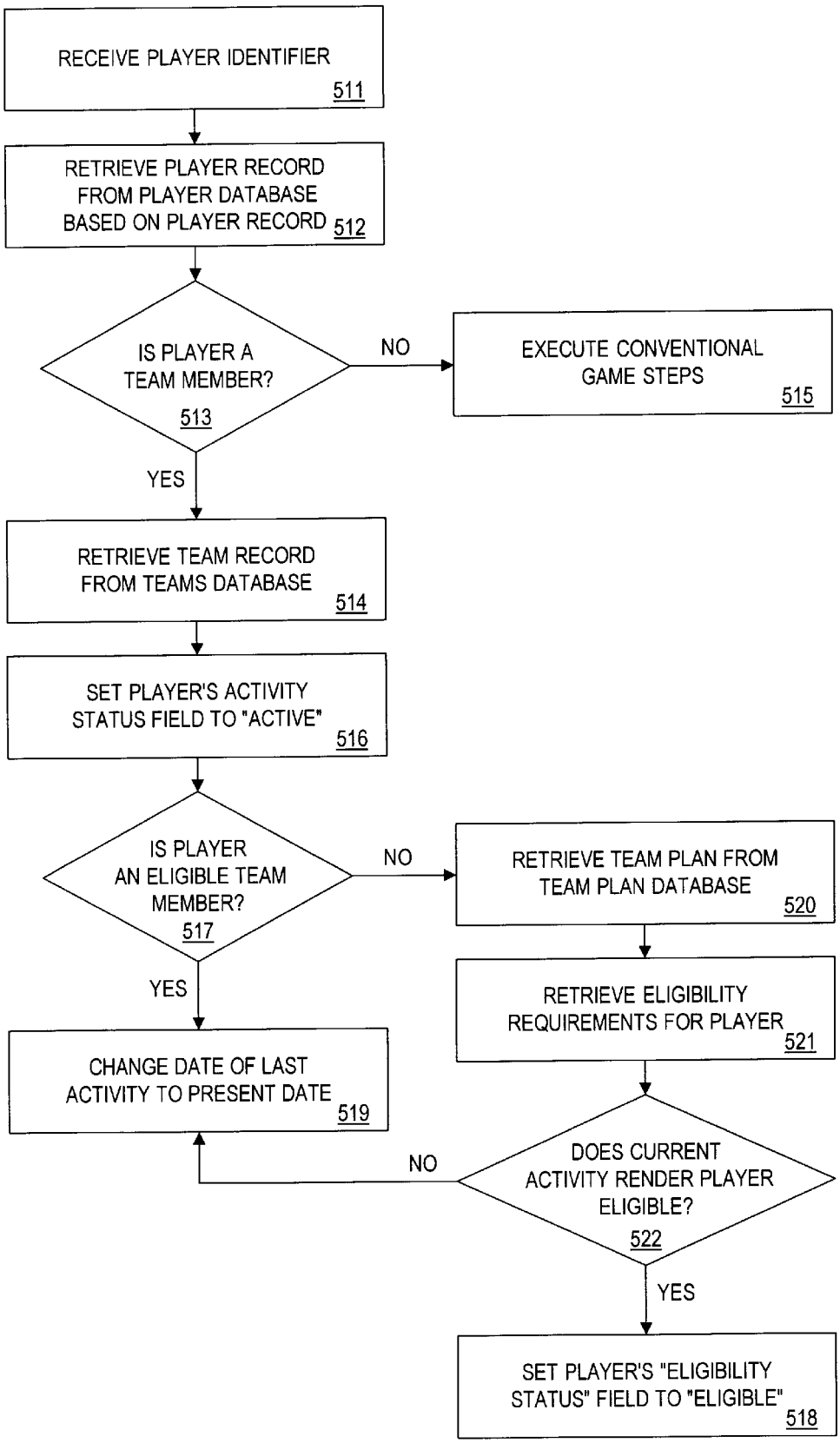
FIG. 8 is a flowchart depicting a process for facilitating the determination of player reward eligibility in accordance with an embodiment of the present invention.

Referring to FIG. 8, the process for determining the eligibility of each player or team member to receive a bonus in accordance with a team plan is controlled by the program code 130 and includes the step 511 of receiving a player identifier. This would occur when a team member inserts a player tracking card into a card reader associated with an electronic gaming machine. Step 512 of the process includes retrieving the player record for the player database 140 contained in storage device 120 based upon the player identifier received in the previous step. Step 513 includes determining whether the player is a member of a team by checking the team identifier field 142 of the player database 140. If the player is a team member, the process advances to step 514. However, if the player is not a team member, i.e., if the team identifier field 142 of the player database 140 is null or contains an entry of "N/A" or "Not Applicable", then processor 110 commands the gaming machine to execute conventional game steps associated therewith at step 515.

Advancement to step 514 includes retrieving the particular team record 50 associated with the identified team member from the teams database 150 contained in storage device 120 (see FIG. 5). After the team record has been retrieved from the teams database 150, the process includes the step 516 of setting the value of the player's activity status in the activity status field 155 of team record 50 to "ACTIVE". Step 517 of the process involves determining whether the identified player is an eligible team member. As stated previously, eligibility is determined by at least one predetermined rule, parameter or condition designated in the team plan database 160. Accordingly, if the identified player is presently ineligible to receive a bonus (i.e., if the value in eligibility status field 154 is set to "NOT ELIGIBLE"), processor 110 advances to step 520 and retrieves the team plan database 160.

At step 521 processor 110 retrieves the eligibility requirement stored in field 165 of the team plan database, based upon the team plan identifier in field 152 of the team record previously retrieved. Thereupon, at step 522 processor 110 determines whether the current activity of the subject player alters the player's eligibility status. For example, if the player is a member of a team utilizing team plan "FGH", the present activity would render the player eligible for a bonus, since the eligibility requirement in field 165 for team plan "FGH" is at least one play session per year. However, if the player is a member of a team utilizing team plan "ABC", the present activity would have no effect on the player's eligibility for a bonus, since the eligibility requirement is not based on activity. Rather, it is based upon whether the player has an outstanding hotel reservation. In the case of the processor determining that the current activity renders the player eligible for a reward, the processor advances to step 518 where the value in the player's eligibility status field 154 in the team record 50 is set to "ELIGIBLE". In the case of the processor determining that the current activity does not render the player eligible for a reward, processor advances to step 519 where the value in field 143 of the player's record in player database 140 is updated to indicate the instant date as the "Date of Last Activity".

Alternatively, if it is determined in step 517 that the player is already eligible to receive a reward because the player has previously met the eligibility requirement designated by the team, then the process advances directly to step 519 and the value in field 143 of the player's record in player database 140 is simply updated to indicate the instant date as the "Date of Last Activity".

In the above example, if the subject player was a member of a team utilizing team plan "DEF", and at step 517 it was determined that the player was ineligible for a bonus, step 522 would include the additional action of retrieving information from an appropriate field in player database 140 to determine whether the present amount wagered by the player has satisfied the eligibility requirement set forth in field 165. Moreover, the processor would determine whether the amount of the present wager caused the total amount wagered by the player during the current calendar year to exceed five hundred dollars. If the present wager did indeed satisfy the eligibility requirement, the player's eligibility status in field 154 would be altered appropriately.

Figure 9A:
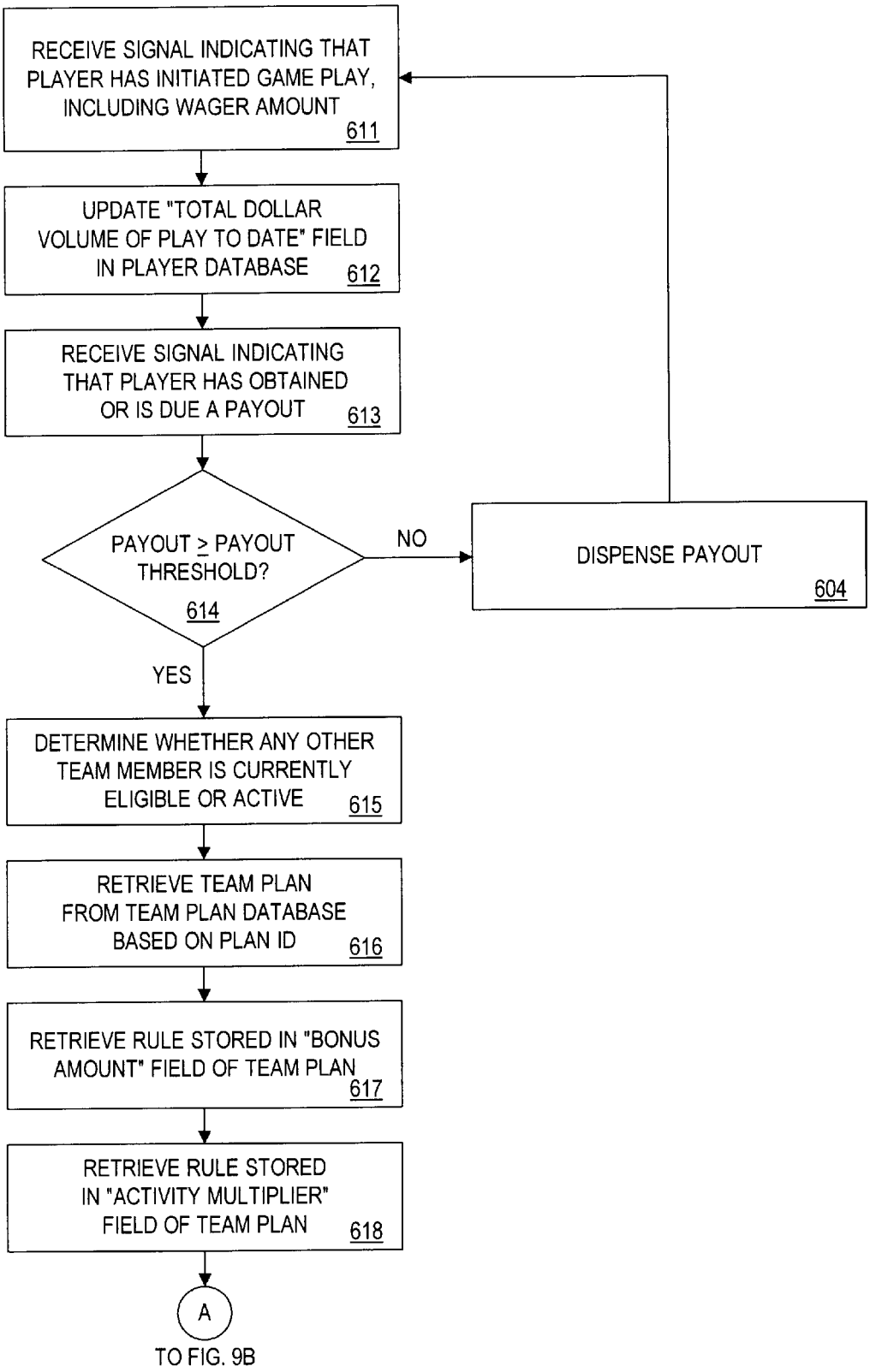
FIG. 9 is a flowchart depicting a process for determining whether a bonus is owed to a player in accordance with an embodiment of the present invention.
Figure 9B:
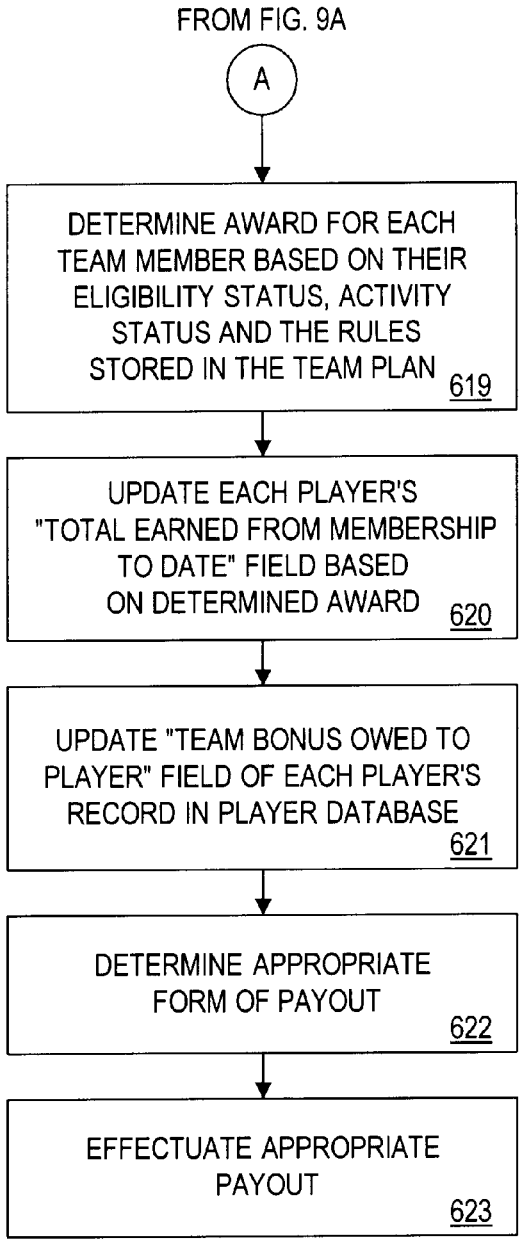

Referring to FIGS. 9A–9B, the process for determining whether a bonus or reward is to be allocated or distributed amongst the members of a particular team registered with the casino slot club is controlled by processor 110 under instruction from program code 130 and includes the step 611 of receiving a signal indicating that a member of a particular team has initiated game play. The signal may be triggered by the player actuating a starting controller on a gaming device, such as starting controller 225 of FIG. 3, and would preferably indicate the amount of the wager placed by the player. At step 612 the processor 110 updates and stores the value in the "Total Dollar Volume of Play To Date" field 144 of player database 140 by adding the amount of the wager to the present total dollar volume of play to date.

At step 613 the process includes receiving a signal from gaming machine 201 indicating that a player has obtained or is due a payout. Once the signal has been received, processor 110 will determine at step 614 whether the payout that has been obtained by or is due to the winning team member is greater than or equal to the payout threshold designated in field 162 of team plan database 160. If the payout received by or due to the winning team member is not greater than or equal to the payout threshold stored in field 162, then processor 110 will dispense the payout to the winning team member at step 604 in a conventional manner and loop back to step 611. However, if the payout obtained by or due to the winning team member is greater than or equal to the payout threshold stored in field 162, then processor 110 proceeds to step 615 wherein a determination is made as to whether any other team member is currently active or eligible.

In essence, step 615 commences a bonus distribution subroutine which includes the step 616 wherein processor 110 retrieves the team plan information from team plan database 160 based upon the team plan identifier associated with the member's team. Thereupon, in steps 617 and 618 the processor retrieves the "Bonus Amount" and the "Activity Multiplier", respectively, from fields 163 and 164 in team plan database 160.

Once the bonus amount and activity multiplier have been retrieved from team plan database 160, processor 110 proceeds to step 619 wherein team member bonuses are determined based upon the information provided for each team member in the respective "Activity Status" and "Eligibility Status" fields 154 and 155 of team record 50 and the appropriate rules set forth in the team plan. In a preferred embodiment of the present invention, the rules comprise the payout threshold the bonus amount and the activity multiplier. Upon determining the amount of the bonus to be distributed to each team member in accordance with the rules defined by the team and stored in the team plan database 160, step 620 enables processor 110 to update each player's total dollar volume earned to date from team membership in field 145 of player database 140 by adding the determined bonus award to the present value stored therein.

The reward determination process further includes the step 621 of updating the data stored in the "Team Bonus Owed To Player" field 146 of player database 140 for each team member receiving a bonus award. Once the player database has been updated, processor 110 advances to step 622 wherein the appropriate form of payout is determined. For example, if it is determined that the payout is to be dispensed to an active player, the processor will signal the gaming machine of the active player to dispense the bonus award in step 623. However, if the team member is not actively playing and the team plan provides for a particular method for paying out awards, i.e., by printing and mailing a reward voucher, the processor will effectuate an appropriate payout in step 623. In such an embodiment, a record in teams database 150 or team plan database 160 would include an appropriate field for storing data indicating the form of the payout. As with other elements of the team plan, the form of the payout may be designated by the members of the team or provided by the casino. Those skilled in the art will readily appreciate that once a player has received a team bonus in accordance with the team plan, either by having it dispensed from a gaming machine, delivered through the mail, transferred to an account, or similarly transmitted by some other well known method, the value of the team bonus owed to the player in field 146 of player database 140 would be set to zero.

Figure 10:
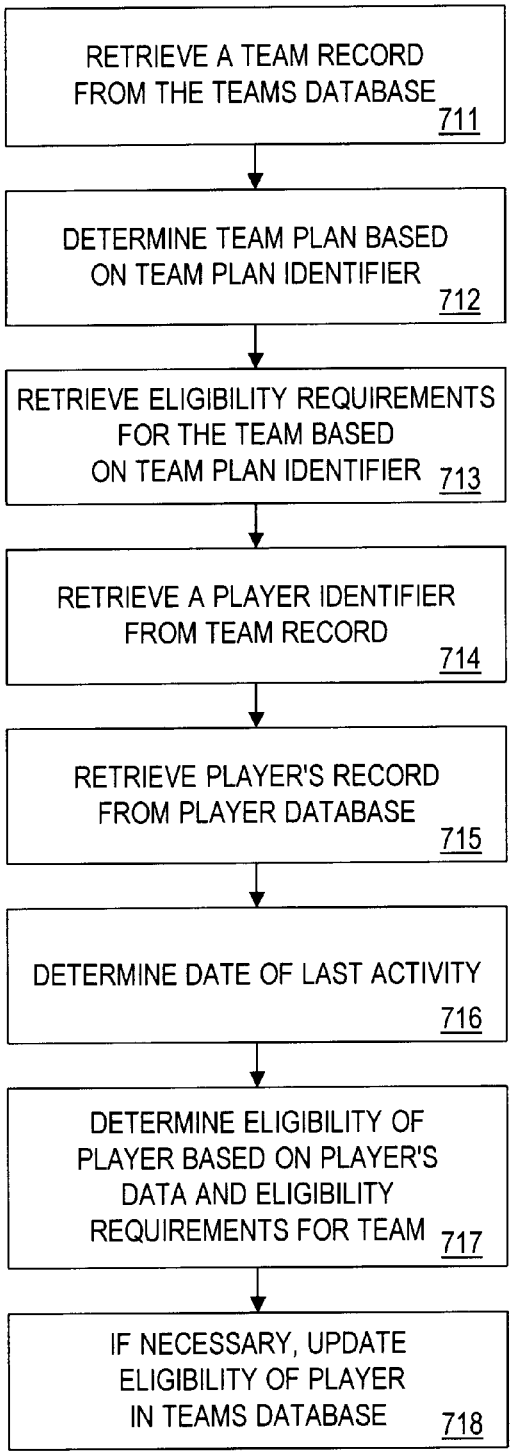
FIG. 10 is a flowchart depicting a process for facilitating the determination of player reward eligibility on a cyclical basis by a server in accordance with an embodiment of the present invention.

Referring now to FIG. 10, there is illustrated a process for updating player eligibility on a periodic basis, such as every evening at midnight. This process includes the step 711 of retrieving a team record 50 from the teams database 150 contained in storage device 120 (see FIG. 5). The process further includes the step 712 which involves determining the team plan based upon the team plan identifier provided in field 152 of team record 50. At step 713 of the process, the eligibility requirements of the team are retrieved from field 165 of the team plan database 160 based upon the common team plan identifier in fields 151 and 161. Step 714 includes retrieving a player identifier from field 153 of team record 50 previously retrieved in step 711, and the step 715 of retrieving the player's record from the player database 140 based upon the player identifier.

Once the player's record has been retrieved, the process advances to step 716 wherein the date of the player's last activity is determined from field 143. At step 717 a determination is made as to whether the player is eligible to receive a reward based upon the player's data and the team's eligibility requirements set forth in field 165 of the team plan database 161. Player data constitutes any type of tracked information relating to a player that is necessary to determine player eligibility. For example, if eligibility depends upon whether a player has an outstanding hotel reservation, as in team plan "ABC", then server 100 would access the hotel reservation system (not shown) in a conventional manner and determine, based upon a player identifier, whether a player does indeed have an outstanding hotel reservation. Player data may also constitute information such as the "Date of Last Activity" stored in field 143 of player database 140. As illustrated in FIG. 6, such player data would be sufficient to determine eligibility in accordance with team plan "BCD". Continuing with the process, at step 718, the player's eligibility status is updated in the appropriate team record 50 contained in the teams database 150, if such action is necessary.

It is envisioned that the process for updating player eligibility may include a subsequent step in which processor 110 determines whether there is another player in the current team record who's eligibility status has not yet been updated. If the determination is affirmative, then processor 110 will return to step 714 and continue from that point. However, if the determination is negative, processor 1 10 will continue to step 719 which involves the retrieval of another team record from teams database 150 and then returning to step 714.

It will be readily appreciated by those skilled in the art that the process of updating player eligibility will be repeated for each team record 50 in the teams database 150. It is envisioned that the order of team record selection during the process would be conducted in a sequential manner based upon the alpha-numeric team identifier provided in each team record contained in teams database 150.

In one embodiment of the present invention. team members receive a password or identification code for accessing a website over the internet. The website would enable team members to monitor team activity remotely and see outcomes achieved by members of their team in real time. Thus, a team member can determine whether a bonus has been distributed without being present at the casino when another team member receives a payout from a gaming machine. In addition, the website can serve as a chat room to enable team members to communicate with one another. It is also envisioned that the act of logging on to the website could serve as a mechanism for altering eligibility status or activity status in fields 154 and 155 of a team database 50. Thus, in such a case it would unnecessary for a team member to physically gamble at a casino to remain active and eligible to receive bonuses.

In another embodiment of the present invention, a team must meet a targeted activity goal in order for the team members to become or remain eligible for rewards or bonuses. For example, at least one team member must have wagered at least one hundred dollars during a one-month period for the team as a whole to be eligible for bonuses. Alternatively, the team as a whole must have earned a predetermined number of points (which may correlate to gambling activity) during a given time period to become or remain eligible for team bonuses. In such instances, the server would periodically review and update a team record in the teams database 150 to reflect whether they have met their targeted activity goal.

In yet another embodiment of the present invention, eligibility for team rewards is based on actual past activity rather than meeting a targeted activity goal. For example, for every thousand dollars wagered by the team during a given time period, e.g., one year, the team would advance one level in a team reward system instituted by the casino. As the team attains higher levels within the system, the team members would be eligible to receive greater rewards. For example, as the team advances through levels of the system, team bonuses rewards would increase incrementally, e.g., in increments of five percent. Thus, at the first level in the system, team members may receive a five percent bonus when a team member receives a winning payout, while at the second level they would receive a ten percent bonus when a team member receives a winning payout. Preferably, the level attained by the team would be stored in the team's record contained in the teams database 150.

It is envisioned that the system and method of the present invention can be utilized by a casino to increase its share of new players as well as its profits. For example, a casino could target groups or clubs planning conventions. The casino would offer members of the group the opportunity to participate in the team gaming program as a way of enhancing the gambling experience and promoting team spirit. Promotional materials may be offered to the group explaining that the subject casino team play format enables players to effectively "hedge their bets," since the success of one player brings success for the entire group. This would mitigate common fears about losing large sums of money.

The present invention also provides casinos with a means of generating revenues by offering customized team gear, such as matching tee-shirts or hats bearing a casino's logo and the team name or logo. Team gear can be purchased in a conventional manner or by redeeming bonus points accumulated by the team members. It is also envisioned that team gear could be offered at no expense upon registration.

As noted hereinabove, in accordance with the present invention, a team plan may be selected from a number of predetermined team plans designed by the casino. It is envisioned that a casino could design team plans aimed at different types of players. For example, one plan aimed at seasonal players would require the team members to play once every six months to remain eligible. The seasonal plan would provide a moderate bonus scheme. Another plan aimed at frequent players would require the team members to play at least twice a month, encouraging those who live within driving distance of a casino to play more often than those who do not. The frequent player plan would have a more attractive bonus scheme than the seasonal plan. In a third plan aimed at regular patrons of the casino, team members would be required to play at least two times a week. Such a plan would provide the most attractive bonus scheme available to the casino club members.

In an effort to encourage frequent team play, a casino may offer a plan in which team bonuses increase in proportion to an increase in the frequency of play or the volume of wagers. A casino may also employ the system of the present invention to increase play at certain times during the day by offering increased team bonus during certain hours of the day in which all of the team members are active when a payout is received by one of the team members.

In sum, a new and useful system and method are provided for facilitating group play by members of a team associated with a casino slot club. This novel and unique system and method serve to enhance the experience of slot machine play by enabling a team to directly influence or orchestrate the distribution of a winning jackpot amongst its members. In so doing, the present invention functions to attract greater numbers of players into a casino, thereby increasing the casino's profits. It also functions to retain players by instilling a sense of player loyalty to a particular casino and creating peer pressure amongst a group of players to actively participate in the slot club on a frequent basis.

It should be recognized that the way in which information is utilized and stored in the various databases described herein does not limit the scope of the subject matter of the present invention in any manner. Rather, the databases and the information stored therein are merely examples of the way in which information may be stored and utilized to enable one skilled in the art to practice the subject invention.

Although the system and method disclosed herein has been described with respect to preferred embodiments, it is apparent that modifications, changes and enhancements can be made thereto without departing from the spirit and scope of the invention as defined by the appended claims.

What is claimed is:

1. A method of facilitating game play by members of a team, comprising the steps of:

identifying the members of the team;

identifying at least one predetermined rule for rewarding the members of the team when a payout is due to a game-playing team member, wherein identifying at least one predetermined rule includes identifying an activity multiplier;

detecting a payout associated with a game-playing team member; and rewarding the members of the team in accordance with the at least one predetermined rule.

2. A method according to claim 1, wherein said step of identifying at least one predetermined rule for rewarding members of the team when a payout is due to a game-playing team member includes identifying a minimum payout threshold for rewarding members of the team.

3. A method according to claim 2, further comprising the step of evaluating whether the payout is greater than the minimum payout threshold.

4. A method according to claim 2, further comprising the step of evaluating whether the payout is less than the minimum payout threshold.

5. A method according to claim 1, wherein said step of identifying at least one predetermined rule for rewarding members of the team when a payout is due to a game-playing team member includes identifying eligibility requirements for rewarding members of the team.

6. A method according to claim 5, further comprising the step of determining the eligibility of each member of the team based upon the at least one predetermined rule.

7. A method according to claim 6, wherein the step of determining the eligibility of each member of the team based upon the at least one predetermined rule includes determining a predetermined minimum wager amount.

8. A method according to claim 6, wherein the step of determining the eligibility of each member of the team based upon the at least one predetermined rule includes determining a predetermined minimum wager amount during a predetermined period of time.

9. A method according to claim 1, wherein the activity multiplier is a unitary amount and team members receive a reward independent of an activity status of individual team members when the payout associated with the game-playing team member is detected.

10. A method according to claim 1, further including the step of determining a condition for effecting bonus multiplication.

11. A method according to claim 10, wherein the step of determining a condition for effecting bonus multiplication includes determining whether a team member is active when the payout is detected.

12. A method according to claim 11, wherein the step of determining whether a team member is active includes determining whether a team member is actively playing a gaming machine when the payout is detected.

13. A method according to claim 1, wherein the step of rewarding members of the team when a payout is due to a game-playing team member comprises distributing a portion of the payout to members of the team other than the game-playing team member in accordance with the at least one predetermined rule.

14. A method according to claim 1, wherein the step of rewarding members of the team when a payout is due to a game-playing team member comprises providing a monetary reward to members of the team other than the game-playing team member in accordance with the at least one predetermined rule.

15. A method according to claim 1, wherein the step of rewarding members of the team when a payout is due to a game-playing team member comprises providing non-monetary reward to members of the team other than the game-playing team member in accordance with the at least one predetermined rule.

16. A method according to claim 1, wherein the step of rewarding members of the team when a payout is due to a game-playing team member includes the step of directing a gaming device to dispense a monetary reward to a member of the team other than the game-playing team member.

17. A method according to claim 1, wherein the step of rewarding members of the team when a payout is due to a game-playing team member includes the step of directing a gaming device to dispense a monetary reward to the game-playing team member.

18. A method of facilitating game play by members of a team, comprising the steps of:

identifying a team member;

identifying a team with which said team member is associated;

identifying a rule set governing allocation of bonuses to the team when a payout is due to the team member, wherein identifying a rule set includes identifying an activity multiplier associated with the team;

receiving a signal indicating that a payout is due to the team member;

evaluating the rule set based in part on the payout to facilitate allocation of bonuses; and allocating bonuses to the team in accordance with the rule set.

19. A method according to claim 18, wherein the step of identifying the rule set governing allocation of bonuses to the team includes identifying at least one rule based upon an amount of the payout.

20. A method according to claim 18, wherein the step of identifying the rule set governing allocation of rewards to the team further includes identifying at least one rule based upon a condition of eligibility.

21. A method according to claim 20, wherein the step of evaluating the rule set includes evaluating a condition of eligibility by determining whether a team member is active when the signal is received.

22. A method according to claim 21, wherein the step of determining whether a team member is active when a payout is obtained includes determining whether the team member is playing a gaming machine when the signal is received.

23. A method according to claim 22, wherein the activity multiplier associated with the team is a unitary value and bonuses are allocated to the team independent of whether individual team members'are active when a team member obtains a payout.

24. A method according to claim 22, wherein the step of allocating bonuses to the team includes applying the activity multiplier to the bonuses in accordance with the rule set.

25. A method of facilitating game play by members of a team associated with a casino comprising the steps of:

registering a team with a casino;

registering the members of the team with the casino; and designating at least one rule for facilitating the distribution of bonuses amongst the members of the team when a particular member of the team receives a payout from a gaming device in the casino, including generating a team plan in a team plans database.

26. A method according to claim 25, wherein the step of registering a team with a casino includes generating a team record in a teams database contained in a data storage device.

27. A method according to claim 25, wherein the step of registering the members of the team with the casino includes generating a player record in a player database contained in a data storage device for each member of the team.

28. A method according to claim 25, wherein the team plans database is contained in a data storage device.

29. A method according to claim 25, wherein the step of generating a team plan includes the step of defining the team plan with a set of rules selected from the group comprising a threshold payout value, a bonus amount, at least one player eligibility requirement, and an activity multiplier.

30. A system for facilitating game play by a team of members, comprising:

a processor;

a memory connected to the processor storing a program to control the operation of the processor;

the processor operative with the program in the memory to:

identify the members of the team;

identify at least one predetermined rule for rewarding the members of the team when a payout is due to a game-playing team member;

identify an activity multiplier designated by the team;

detect a payout due to a game-playing team member; and reward the members of the team in accordance with the at least one predetermined rule.

31. A system according to claim 30, wherein the processor is further operative with the program in the memory to identify a minimum payout threshold for rewarding members of the team.

32. A system according to claim 31, wherein the processor is further operative with the program in the memory to evaluate whether the payout is greater than the minimum payout threshold.

33. A system according to claim 31, wherein the processor is further operative with the program in the memory to evaluate whether the payout is greater than or equal to the minimum payout threshold.

34. A system according to claim 30, wherein the processor is further operative with the program in the memory to identify eligibility requirements for rewarding members of the team.

35. A system according to claim 34, wherein the processor is further operative with the program in the memory to determine the eligibility of each member of the team based upon the at least one predetermined rule.

36. A system according to claim 35, wherein the processor is further operative with the program in the memory to determine a predetermined minimum wager amount.

37. A system according to claim 35, wherein the processor is further operative with the program in the memory to determine a predetermined minimum wager amount during a predetermined period of time.

38. A system according to claim 30, wherein the activity multiplier designated by the team is a unitary amount and team members receive a reward independent of an activity status of individual team members when the payout due to the game-playing team member is detected.

39. A system according to claim 30, wherein the processor is further operative with the program in the memory to determine a condition for effecting bonus multiplication.

40. A system according to claim 39, wherein the processor is further operative with the program in the memory to determine whether a team member is active when the payout is detected.

41. A system according to claim 40, wherein the processor is further operative with the program in the memory to determine whether a team member is actively playing a gaming machine when the payout is detected.

42. A system according to claim 30, wherein the processor is further operative with the program in the memory to distribute a portion of the payout to members of the team other than the game-playing team member in accordance with the least one predetermined rule.

43. A system according to claim 30, wherein the processor is further operative with the program in the memory to provide a monetary reward to members of the team other than the game-playing team member in accordance with the at least one predetermined rule.

44. A system according to claim 30, wherein the processor is further operative with the program in the memory to provide non-monetary reward to members of the team other than thed game-playing team member in accordance with the at least one predetermined rule.

45. A system according to claim 30, wherein the processor is further operative with the program in the memory to direct a gaming device to dispense a monetary reward to a member of the team other than the game-playing team member.

46. A system according to claim 30, wherein the processor is further operative with the program in the memory to direct a gaming device to dispense a monetary reward to the game-playing team member.

47. A system for facilitating game play by a team of members associated with a casino slot club comprising:

a) a memory storage device containing, i) a player database including a player record for each member of the club, each player record having at least a player identifier and a team identifier indicating the team with which a player is associated, ii) a teams database including a team record for each team associated with the club, each team record having at least a player identifier identifying each member of the team, a team identifier and a team plan identifier, and iii) a team plan database including a team plan record for each team, each team plan record having at least the team plan identifier associated therewith and a rule set for facilitating the allocation of rewards to the members of the team when a payout is due to a particular team member; and b) a processor in communication with the memory storage device, said processor adapted and configured to, i) receive a first player identifier from a gaming machine, the first player identifier corresponding to a first team member, ii) receive a signal from said gaming machine indicating a payout is due to the first team member, iii) retrieve a first player record from the player database based upon the first player identifier, iv) determine a first team identifier from the first player record, v) retrieve a first team record from the team database based upon the first team identifier, vi) determine a first team plan identifier from the first team record, vii) retrieve a first team plan record from the team plan database based upon the first team plan identifier, viii) determine a first rule set from the first team plan record, ix) evaluate the first rule set based at least upon the payout, and xi) distribute a reward to each team member identified in the first team record in accordance with the first rule set.

48. A system as recited in claim 47, wherein the processor is adapted and configured to evaluate the first rule set based at least upon an amount of the payout and data stored in the first team record.

49. A system as recited in claim 48, wherein the data stored in the first team record includes data relating to player eligibility status and player activity status.

50. A system as recited in claim 49, wherein the processor is adapted and configured to update player eligibility status and player activity status on a periodic basis.

51. A system as recited in claim 50, wherein the processor is adapted and configured to determine an activity multiplier from the first team plan record based upon the first team plan identifier.

52. A system as recited in claim 51, wherein the processor is adapted and configured to determine a reward amount based at least upon the activity multiplication factor.

53. A computer-readable storage medium encoded with processing instructions for implementing a method of facilitating game play by a team of members, the processing instructions for directing a computer to:

identify the members of the team;

identify at least one predetermined rule for rewarding the members of the team when a payout is due to a game-playing team member, wherein identifying at least one predetermined rule includes identifying an activity multiplier associated with the team;

detect a payout due to a game-playing team member; and reward the members of the team in accordance with the at least one predetermined rule.

* * * * *